US007887464B1

(12) United States Patent
Jones et al.

(10) Patent No.: US 7,887,464 B1
(45) Date of Patent: Feb. 15, 2011

(54) DEVICE FOR MECHANICALLY ASSISTING HUMAN WALKING MOTION FOR REHABILITATION PURPOSES

(76) Inventors: Jasper Jones, 1010 Drake St., Roanoke Rapids, NC (US) 27810; Dorothy Jones, 1010 Drake St., Roanoke Rapids, NC (US) 27870

( * ) Notice: Subject to any disclaimer, the term of this patent is extended or adjusted under 35 U.S.C. 154(b) by 0 days.

(21) Appl. No.: 12/657,584

(22) Filed: Jan. 25, 2010

(51) Int. Cl.
*A63B 22/00* (2006.01)

(52) U.S. Cl. ..... 482/51; 601/35

(58) Field of Classification Search ..... 482/1, 482/4, 6, 7, 51, 52, 53, 57, 70, 79, 80, 148; 601/23, 33, 34, 35; 434/247, 255
See application file for complete search history.

(56) References Cited

U.S. PATENT DOCUMENTS

| | | | | | |
|---|---|---|---|---|---|
| 3,531,112 | A | * | 9/1970 | Gibbs | 482/112 |
| 3,824,994 | A | * | 7/1974 | Soderberg, Sr. | 601/29 |
| 4,720,093 | A | * | 1/1988 | Del Mar | 482/52 |
| 4,768,536 | A | | 9/1988 | Hawkins | |
| 4,838,543 | A | * | 6/1989 | Armstrong et al. | 482/53 |
| 4,922,860 | A | | 5/1990 | Hutchings | |
| 5,168,947 | A | | 12/1992 | Rodenborn | |
| 5,207,621 | A | * | 5/1993 | Koch et al. | 482/53 |
| 5,282,486 | A | | 2/1994 | Hoover | |
| 5,313,971 | A | | 5/1994 | Upshaw | |
| 5,390,753 | A | | 2/1995 | Parker | |
| 5,411,044 | A | | 5/1995 | Andolfi | |
| 5,490,818 | A | * | 2/1996 | Haber et al. | 482/52 |
| 5,778,996 | A | | 7/1998 | Prior et al. | |
| 5,803,880 | A | * | 9/1998 | Allen | 482/113 |
| 5,830,111 | A | * | 11/1998 | Johnston | 482/52 |
| 7,354,406 | B2 | * | 4/2008 | Kim | 601/29 |
| 7,731,635 | B2 | * | 6/2010 | Dyer | 482/52 |
| 2009/0298653 | A1 | * | 12/2009 | Rodetsky et al. | 482/69 |
| 2010/0152001 | A1 | * | 6/2010 | Gordon | 482/53 |

* cited by examiner

*Primary Examiner*—Loan Thanh
*Assistant Examiner*—Tam Nguyen
(74) *Attorney, Agent, or Firm*—Theresa M. Seal

(57) ABSTRACT

A motorized rehabilitative device for simulating and inducing normal walking motion for individuals needing physical rehabilitation includes a base, a pair of side supporting members, and adjustable u-shaped handle bars mounted to the side supporting members. Each side supporting member includes an interiorly mounted foot bar and foot bar support plate that are capable of reciprocable up and down motion to simulate and facilitate the walking motion of the individual disposed on the device having one foot secured to each foot bar and positioned upright and between the side supporting members with the handle bars used as support. The foot bars and foot bar support plates are interconnected to motor driven gear and pulley systems contained with the side supporting members and the gear and pulley systems include cyclically extending and retracting pistons that transfer mechanical motion to the foot bars and the speed of motion being controllable from a handle bar mounted control panel.

10 Claims, 5 Drawing Sheets

DEVICE FOR MECHANICALLY ASSISTING HUMAN WALKING MOTION FOR REHABILITATION PURPOSES

FIELD OF THE INVENTION

The present invention pertains to rehabilitation and convalescent devices, and more particularly pertains to a device that simulates normal human walking motion for rehabilitation purposes.

BACKGROUND OF THE INVENTION

Therapeutic and rehabilitative programs and devices have improved markedly in recent years. Physical therapy techniques to alleviate, improve, strengthen and heal tendon, ligament and muscle injuries, broken bones and long term physical disabilities are widely used to complement drug and surgical medical techniques and practices. Many different types of techniques and practices are used in the rehabilitation of injuries to the lower extremities such as the hips, legs and feet. For example, one of the simplest of rehabilitative devices is a device that comprises two parallel poles, supported at opposed ends by stanchions, with the poles spaced from each other along their length a sufficient width for supporting an individual traversing the length of the poles. The individual, with therapists walking alongside for safety, supports himself or herself by gripping the poles for maintaining an upright position while slowly traversing the length of the poles. In such manner leg and foot strength can be slowly built up. However, this common rehabilitative device does require that the individual posses sufficient arm and upper body strength for maintaining the body in an upright disposition in order to successfully traverse the length of the poles. Other types of rehabilitative devices for strengthening the lower extremities include universal gym-type devices and resistance training devices.

The prior art discloses several devices in the general area of lower extremity rehabilitation.

For example, the Schumann et al. patent (U.S. Pat. No. 5,620,411) discloses an ankle brace walker that includes a foot plate to which upright side brace members are attached via lateral and medial side plates. In order to distribute shear forces that occur during an applied toe load, the lateral and medial side plates each include an elliptical intermediate plate portion that is integrally joined thereto. A composite outsole is attached to the underside of the foot plate to cushion and support the individual's gait.

The Kuo patent (U.S. Pat. No. 6,482,131 B2) discloses a step adjuster of an oval track walker that includes a pair of parallel assembly frames interconnected by a rod with each assembly frame including a sector gear pivotally mounted to each opposed end of the rod. Each sector gear is further connected to an adjusting arm with the adjusting arm mounted to a block that slides in a groove. The rotation of the sector gear can be adjusted by turning a hand crank that has a worm gear meshed to the gear teeth of the sector gear; and by turning the hand crank in one direction or the other, the position of the adjusting arm and the slidable block are varied thereby shortening or lengthening the user's step.

Nonetheless, despite the ingenuity of the above devices, there remains a need for a rehabilitative device that is easy and simple to use and operate, supports the individual while avoiding the risk of the individual falling and sustaining further injury, and can be incorporated into various types of rehabilitation programs.

SUMMARY OF THE INVENTION

The present invention comprehends a device for rehabilitative purposes, with an emphasis on rehabilitating and strengthening the lower extremities, such as the hips, legs and feet, in order to recover and recuperate from an ailment or injury that has been sustained. The device is stationarily placed upon a floor surface and includes motorized mechanical components that induce and propel the legs in an up-and-down motion thereby simulating the normal walking motion or human gait and facilitating the recuperative process and the regaining of physical strength and coordination.

The rehabilitative device includes a base from which a pair of spaced-apart side supporting members upwardly extends. The side supporting members are spaced from each other a sufficient distance to allow an individual to stand in a comfortably upright position between the side supporting members. Each side supporting member includes an adjustable handle bar that the individual can grip to support him or herself on the device. The handle bars are independently adjustable to accommodate the varying heights of individuals. Each side supporting member includes an interior side, and mounted against each interior side is a foot bar and associated foot bar support plate. Each foot bar support plate includes a foot strap sized to comfortably and securely encompass the ankle portion of the lower leg of the individual. The individual places his feet on each respective foot bar, and attaches each foot strap around the ankle portion to secure the legs to the device. The foot bars and foot bar support plates are engaged for movement from a control panel mounted on one handle bar for vertical and reciprocable up and down motion to mechanically simulate and induce normal human walking motion for assisting and encouraging the recuperation and rehabilitation of the individual's lower extremity injuries. Disposed within each side supporting member are a piston and a piston tube. The piston is interconnected to a gear and pulley arrangement with both gear and pulley arrangements actuated by a small horsepower motor encased within each side supporting member with the motor—and the device—being actuated for operation from the control panel buttons. Each piston is also connected to the respective foot bar so that the reciprocable up and down motion of the pistons are transmitted to the foot bars, and the reciprocation of the pistons are timed through the gear and pulley arrangements for two stroke cycling so that the up motion of one foot bar is concurrent with the down motion of the other foot bar thereby mechanically simulating normal human walking motion or gait.

It is an objective of the present invention to provide a motorized walking device for the rehabilitation of lower extremity injuries and ailments involving primarily the hips, legs and feet.

It is another objective of the present invention to provide a motorized walking device for rehabilitation purposes that can be used by both young and old individuals and can accommodate lower extremities of different sizes, lengths and configurations.

It is yet another objective of the present invention to provide a motorized walking device for rehabilitation purposes that stabilizes the legs while mechanically assisting and propelling the legs for simulating the complete walking motion or gait.

It is still yet another objective of the present invention to provide a motorized walking device for rehabilitation purposes that is adjustable to different speeds to enhance the mechanical simulation of the individual's gait or walking motion.

Still yet another objective of the present invention is to provide a motorized walking device for rehabilitation purposes that comfortably and stably supports the individual while using the machine and prevents the individual from falling and being injured.

Still yet a further objective of the present invention is to provide a motorized walking device for rehabilitation purposes that prevents the individual from falling and injuring himself or herself while using the device to regain physical strength and coordination.

These and other objects, features, and advantages will become apparent to those skilled in the art upon a perusal of the following detailed description read in conjunction with the accompanying drawings and appended claims.

DETAILED DESCRIPTION OF THE PREFERRED EMBODIMENT

Figure 1:
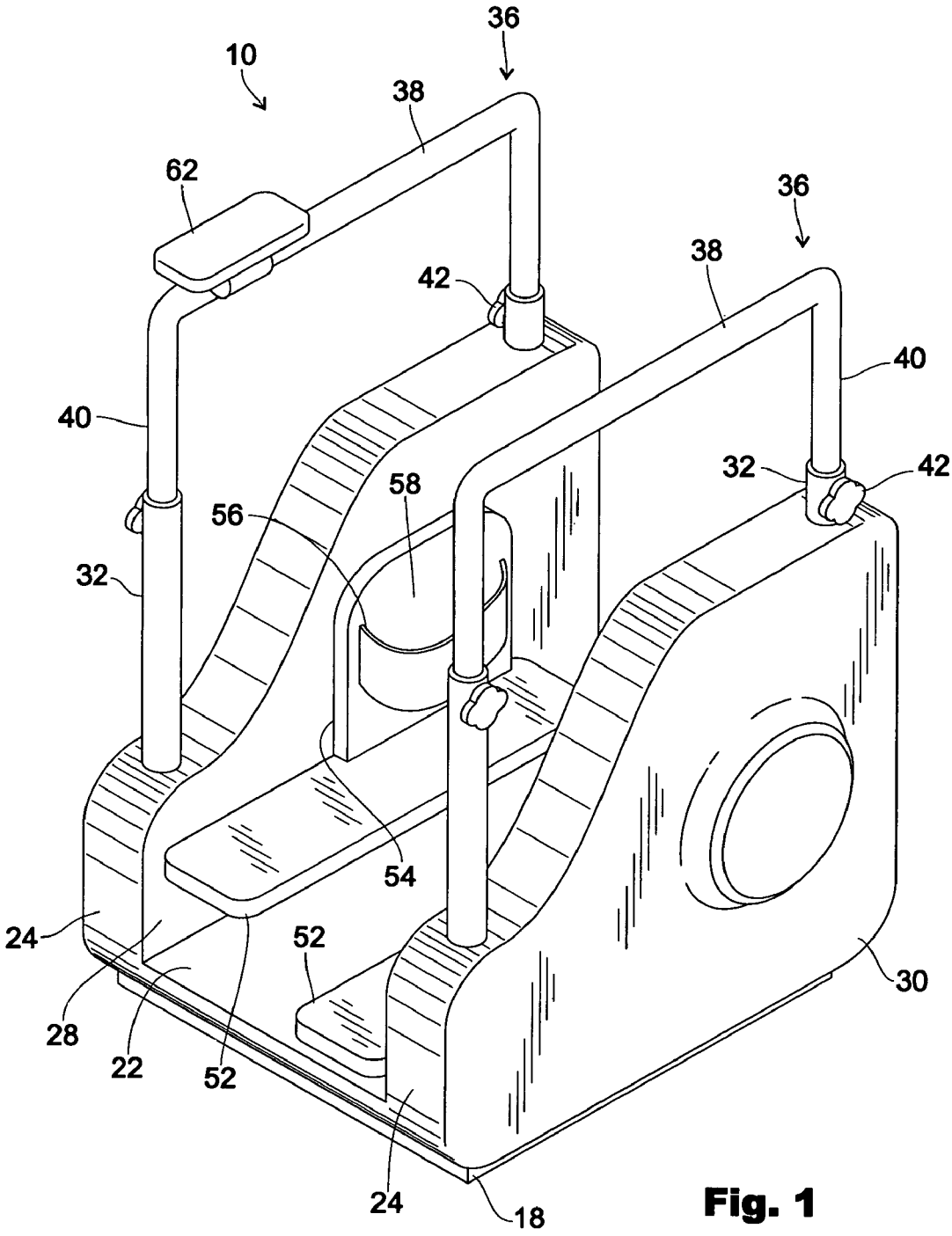
FIG. 1 is a perspective view of the preferred embodiment of the motorized rehabilitative walking device of the present invention.
Figure 2:
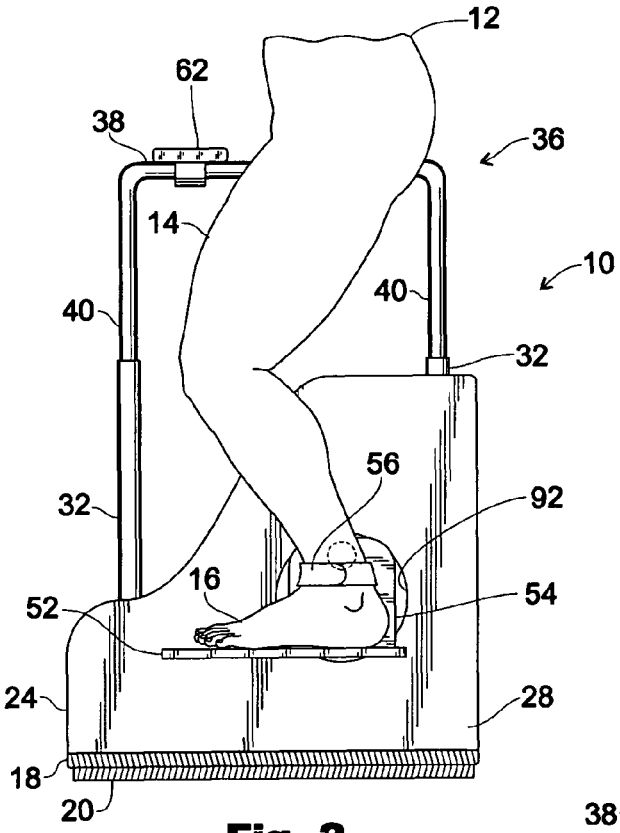
FIG. 2 is a side elevational view of the motorized rehabilitative walking device of the present invention illustrating the attachment to a foot strap to of one of the legs of the individual undergoing rehabilitation with the individual's foot resting upon the foot bar.
Figure 3:
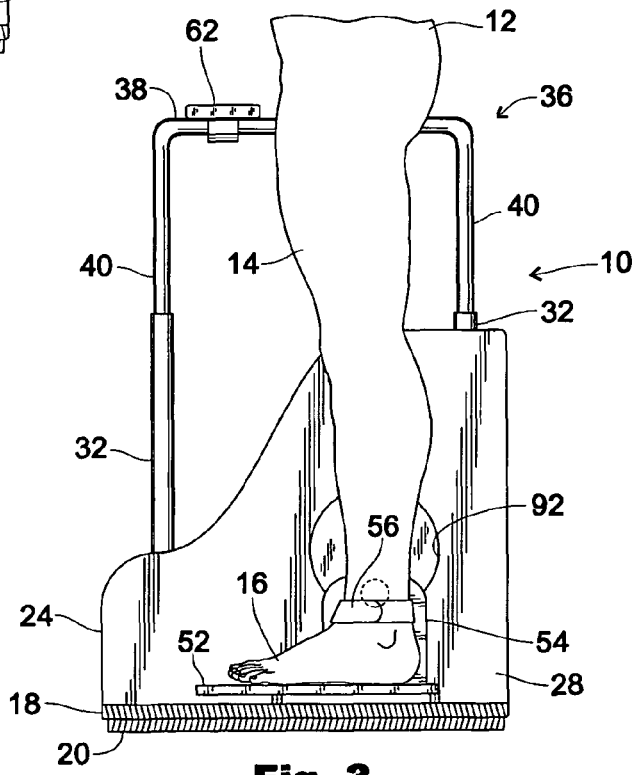
FIG. 3 is a side elevational view of the motorized rehabilitative walking device of the present invention illustrating the attachment of the foot to the foot strap and the individual's leg in the fully extended position with the foot of the individual resting upon and in contact with the foot bar.
Figure 4:
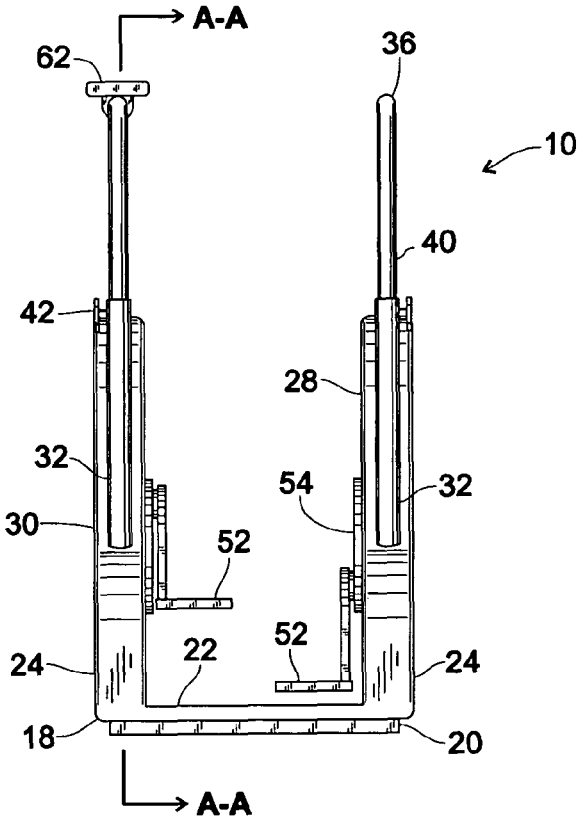
FIG. 4 is a front elevational view of the motorized rehabilitative walking device of the present invention illustrating the dispositions of the foot bars at different elevations thereby simulating the range of movement of the individual's legs through the normal walking motion or gait.
Figure 5:
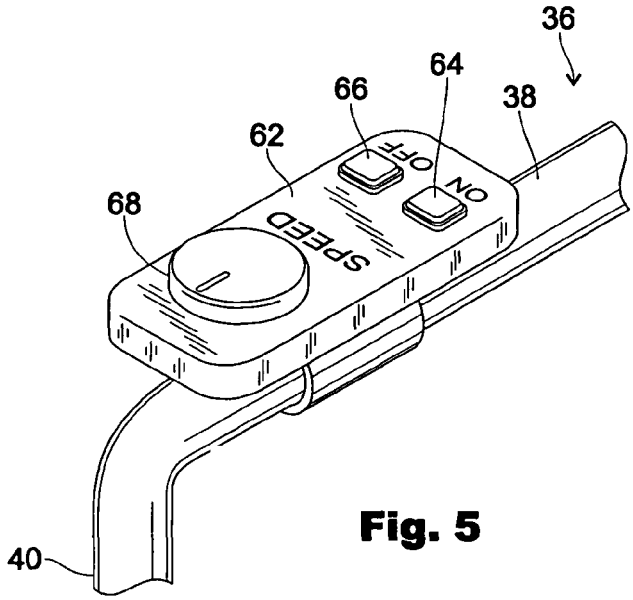
FIG. 5 is a perspective view of the motorized rehabilitative walking device of the present invention illustrating a control panel mounted to one handle bar of the device.

Illustrated in FIGS. 1-8 is a device 10 used for rehabilitative purposes, and specifically used for rehabilitating the lower extremities, such as the hips 12, legs 14, and feet 16, as shown in FIGS. 2 and 3, so that those appendages and body areas can regain their coordination, strength and normal functioning after sustaining an ailment or injury. The rehabilitative device 10 is motorized for mechanically simulating the normal human walking motion or gait, and for assisting and facilitating the physical walking motion of the individual using the device 10. Although the device 10 may be referred to as a "walking machine," the device 10 in use is stationary upon the ground, and while the device 10 is similar to Nautilus-type stepping machines, the device 10 of the present invention is primarily designed and intended for rehabilitative purposes. The device 10 is capable of operating at various speeds consonant with the pace of physical rehabilitation of each individual, and can be at least partially disassembled or broken down for transport and storage.

Illustrated in FIGS. 1-8 is the rehabilitative motorized walking device 10 that includes a generally square or rectangular-shaped base 18 for disposition on a flat floor surface, such as in a physical therapy room or the basement or game room of a residential dwelling. The base 18 includes a flat, non-skid or non-slip wear member 20, preferably of rubber, that contacts the floor surface, and an opposite inner platform 22. Mounted on two opposed sides of the base 18 are upwardly extending side supporting members 24. The base 18 is appropriately sized so that the side supporting members 24 are sufficiently spaced from each other to allow the individual to comfortably and stably stand in between the side supporting members 24. The side supporting members 24 include a hollow interior 26 for accommodating structural components related to the motorized feature of the device 10 that will be hereinafter further described. Each side supporting member 24 includes an interior side 28 and an opposite external side 30. Each side supporting member 24 includes a pair of upwardly extending, hollow stanchions or receiving posts 32 with each receiving post 32 having an open upper end 34. The upper ends 34 of each pair of receiving posts 32 slidably receive therein a height adjustable handle bar 36. The handle bars 36 have a generally u-shaped configuration, and each handle bar 36 includes a horizontal portion 38 that can be gripped by the individual so that individual can support him or herself in an upright disposition while using the device 10, and a pair of spaced-apart, downwardly projecting portions 40 integrally formed to the horizontal portion 38. The ends of the downwardly projecting portions 40 are slidably insertable into the respective open upper ends 34 of the receiving posts 32.

Figure 7:
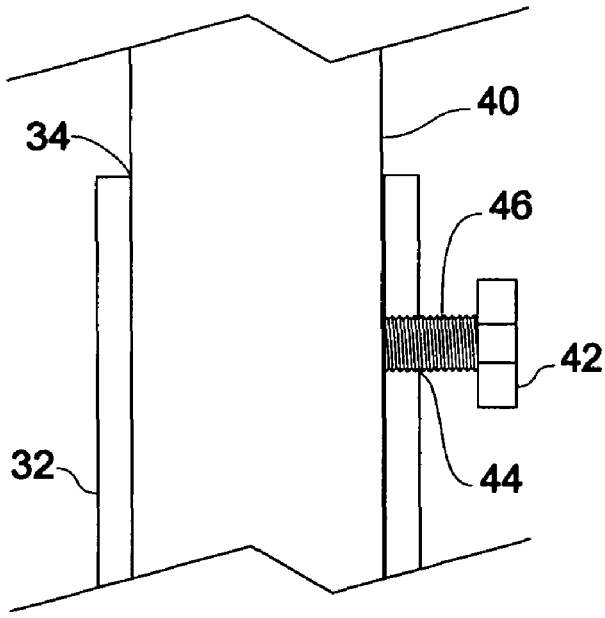
FIG. 7 is a sectioned side elevational view of the motorized rehabilitative walking device of the present invention illustrating the adjustable capability of the handle bar and a preferred embodiment for locking the handle bar in place.
Figure 8:
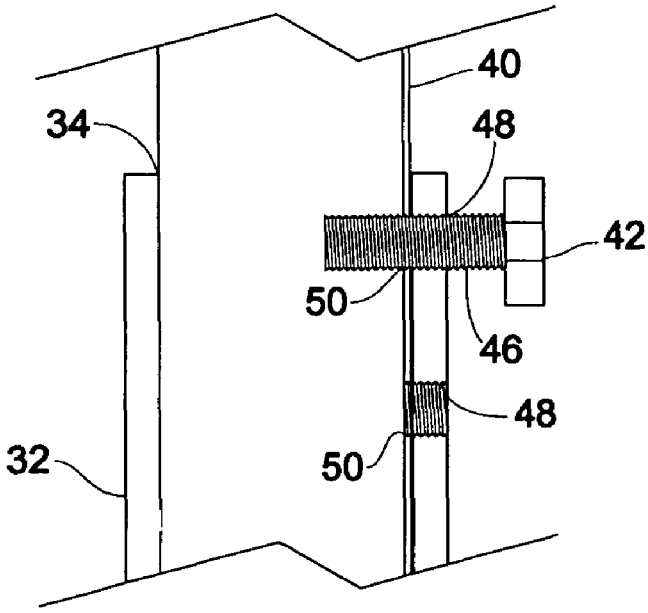
FIG. 8 is a sectioned side elevational view of the motorized rehabilitative walking device of the present invention illustrating the adjustable capability of the handle bar and an alternative embodiment for locking the handle bar in place.

Because the individuals using the rehabilitative device 10 will be of varying heights, and have varying arm lengths, the handle bars 36 are adapted for slidable and independent adjustment on the respective receiving posts 32 for accommodating such differences in size and height. As shown in FIGS. 1, 7 and 8, a manually operable locking and releasing knob 42 is mounted adjacent the open upper end 34 of each receiving post 32. Each knob 42 is ergonomically designed for ease of gripping and turning in order to rotate the knobs 42 for locking the handle bars 36 in place after the desired height adjustment is achieved; and for rotating the knobs 42 for releasing the handle bars 36 for re-adjustment or for removal to facilitate the transport and storage of the device 10.

FIGS. 7 and 8 disclose several embodiments for a locking and releasing means for the selective and independent adjustment of the handle bars 36. The handle bar locking and releasing means of FIG. 7 includes a threaded aperture 44 located on the receiving post 32 adjacent the open upper end 34. The knob 42 includes a threaded stem or shaft 46 that is insertable into and through the threaded aperture 44. The downwardly projecting portions 40 of each handle bar 36 are slidably insertable into the open upper ends 34 of each pair of receiving posts 32 and can be moved up and down until the desired handle bar 36 height is attained. The knobs 42 are then rotated so that the stems 46 extend through the threaded apertures 44 so that the stems 46 tightly and securely abut the external surfaces of the downwardly projecting portions 40 of the handle bar 36 thereby fixing and locking each handle bar 36 in position. The handle bars 36 are released by simply rotating the knobs 42 in the opposite direction thereby disengaging the stems 46 from abutting contact with the surfaces of the downwardly projecting portions 40 of the respective handle bars 36.

FIG. 8 illustrates a second alternative embodiment for the handle bar locking and releasing means and includes a plurality of threaded apertures 48 spaced along the receiving post 32 and adjacent the open upper end 34. The downwardly projecting portion 40 of each handle bar 36 also includes spaced-apart threaded apertures 50, and for adjusting the height of each handle bar 36, one aperture 50 of the downwardly projecting portion 40 is brought into alignment with the corresponding aperture 48 of the receiving post 32 so that the stem 46 of the knob 42 can be inserted through both apertures 48 and 50 thereby fixing and locking the handle bar 36 in position and at the desired height. In order to readjust the handle bar 36, or to completely remove the handle bar 36 from the receiving posts 32, the knobs 42 are turned until the shafts 46 are completely withdrawn from the respective threaded apertures 50 on the downwardly projecting portions 40 thus disengaging the knobs 42 from their locking engagement to the downwardly projecting portions 40 and allowing for the slidable movement and adjustment—or removal—of the respective handle bars 36.

As shown in FIGS. 1-4 and 6, a pair of oppositely disposed foot bars 52 supports each foot 16 of the individual during use of the device 10. Each foot bar 52 is a horizontally extending structure that is disposed adjacent the interior side 28 of each side supporting member 24. The foot bars 52 are capable of reciprocable up and down motion for simulating the normal human gait as will be hereinafter further described. Each foot bar 52 is integrally attached to a foot bar support plate 54 that slides against the respective interior side 28 of the side supporting member 24 concomitant with the slidable reciprocable movement of each foot bar 52. In addition, as shown most distinctly in FIGS. 2 and 3, each foot bar support plate 54 includes a flexible foot strap 56 having opposed strap ends that are attached to the foot bar support plate 54. The foot straps 56 are preferably composed of a comfortable cloth-like material and define an opening 58 through which the individual can insert his foot 16 for placing the sole of the foot 16 on the foot bar 52 with the foot strap 56 extending about the ankle portion of the foot 16. The foot straps 56 stabilize the legs 14 while the individual is using the device 10 and prevent the foot 16 from slipping off of the foot bar 52.

Figure 6:
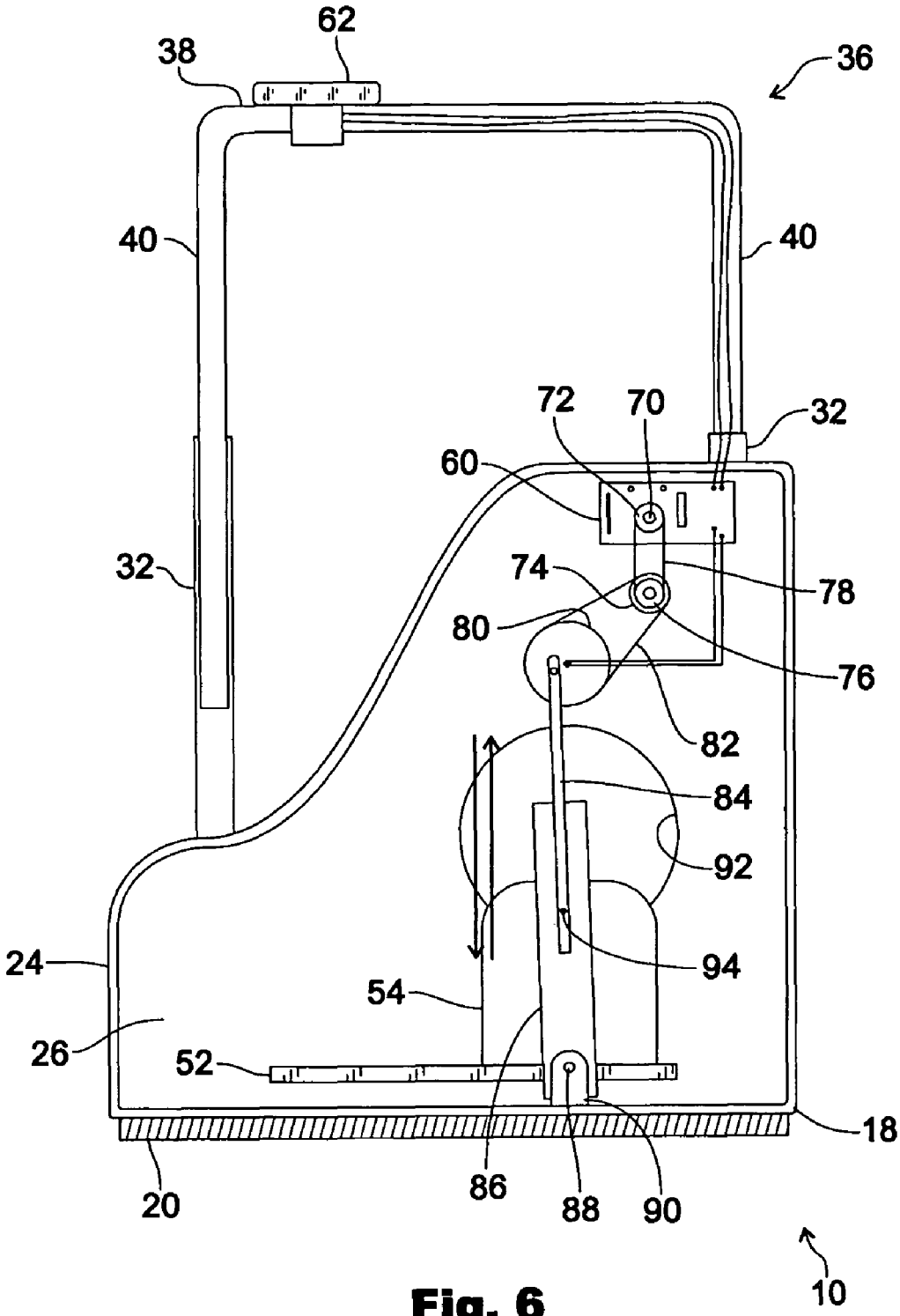
FIG. 6 is a sectioned elevational view of the motorized rehabilitative walking device taken along lines A-A of FIG. 4 illustrating internal structural components of the rehabilitative device that raise and lower the foot bars to simulate and assist the normal human walking motion.

As shown in FIG. 6, the device 10 includes components that mechanically raise and lower each foot bar 52 and foot plate 54 in a sequential and cyclic manner for simulating normal human walking motion and for assisting the individual in regaining strength and coordination by using the device 10. The mechanical components are contained within the interior 26 of each side supporting member 24 thereby providing for the safe use of the device 10 as the individual using the device 10 is protected from the mechanical operation of the device 10. Disposed within the interior 26 of each side supporting member 24 is a small horsepower motor 60, and both motors 60 are electrically interconnected to a control panel 62 mounted on the horizontal portion 38 of one handle bar 36. Alternatively, the control panel 62 may be mounted on one side supporting member 24. In either case, the control panel 62 includes a device on push button 64, a device off push button 66, and a speed control dial 68 that controls the speed of operation of the device 10 (the speed with which the foot bars 52 move up and down in their timed and cyclic motion for simulating human gait). The motor 60 is also electrically interconnected to mechanical components contained within the interiors 26 of both side supporting members 24. It should be noted that the mechanical components contained within the interior 26 of the side supporting member 24 of FIG. 6 are identical to the mechanical components contained within the other (not shown) side supporting member 24.

Thus, as shown in FIG. 6, a drive shaft 70 extends from the motor 60 and mounted to the drive shaft 70 is a main drive pulley 72. Large and small intermediate pulleys 74 and 76 are coaxially mounted and are located beneath the main drive pulley 72, and a first endless belt 78 drivingly interconnects the main drive pulley 72 with the small intermediate pulley 76. The large intermediate pulley 74 is drivingly interconnected to a reciprocating pulley 80 by a second pulley belt 82. A first end of a piston 84 is eccentrically mounted to the reciprocating pulley 80 with the lower end of the piston 84 contained within a piston tube or cylinder 86 with the piston 84 capable of slidable reciprocable up and down linear motion within the cylinder 86. The cylinder 86 is trunnion mounted to the interior floor of the side supporting member 24 by a pin 88 that pivotally interconnects the cylinder 86 at its lower end to a pair of brackets 90 (only one of which is shown in FIG. 6). The trunnion mounting of the cylinder 86 to the brackets 90 allows the cylinder 86 to pivot concomitant with the eccentric revolution of the piston 84 on the reciprocating pulley 80 which action imparts reciprocating motion to the piston 84 relative to the cylinder 86. An opening 92 formed on the interior side 28 of the side supporting member 24 allows a connection pin or dowel 94 to project through the opening 92 and fix the foot bar support plate 52 and the foot bar 52 to the lower end of the piston 84. The opening 92 is circular-shaped, as shown in FIGS. 2 and 3, and the connection pin 94 will extend through the cylinder wall for securement to the foot bar support plate 54. Thus, the foot bar support plate 54, the foot bar 52, and the piston 84 move up and down as one unit during operation of the device 10. The distance the piston 84 reciprocably travels to move the leg 14 through a full range of motion is not that great is indicated by FIGS. 2 and 3. Furthermore, the pistons 84 should be set so that they reciprocate (extend and retract within the cylinders 86) out of phase by one cycle whereupon as one piston 84 is rising to thereby raise the foot bar 52—and the individual's leg 14 as shown in FIG. 2—the other piston 84 is retracting to lower its associated foot bar 52—and the individual's leg 14—as shown in FIG. 3. If both pistons 84 reciprocated in phase, they would rise and fall in unison defeating the purpose of the device 10 to simulate and facilitate the action of normal human walking motion or gait. In addition, the opening 92 in the interior side 28 of the side supporting member 24 is necessary to accommodate the extension of the connection pin 94 and the slight back and forth pivotal motion of the eccentrically mounted piston 84 as the piston 84 both revolves on the reciprocating pulley 80 and slightly pivots back and forth along a small arc concomitant with the pivotal motion of the cylinder 86 on the brackets 90.

In operation the individual would slide each foot 16 through the opening 58 of the foot strap 56 so that the sole of each foot 16 would contact and rest upon the foot bar 52. The handle bars 36 would be adjusted to the appropriate level so that the individual is able to comfortably support himself in an upright position by gripping and holding onto the horizontal portions 38 of the handle bars 36. The locking and releasing knobs 42 would then be tightened against the downwardly projecting portions 40 or into and through the downwardly projecting portions 40 as aforedescribed and shown in FIGS. 1, 7 and 8. The speed control dial 68 would be set at the desired speed dependent upon such factors as the age of the individual, the condition requiring rehabilitation and the current physical capacity of the individual. While the device 10 can be operated solo, as it were, it is advisable, especially when rehabilitating infirm or elderly individuals, to have an attendant, such as a physical therapist or family member, nearby as an additional safety precaution and measure. With the individual properly positioned upon the foot bars 52, the device on button 64 would be pushed thereby actuating the motors 60 to engage the pulley and belt drive system located within the interior 26 of each side supporting member 24. This engagement will in turn cause the reciprocating action of each piston 84 to commence (the extension of one piston 84 concomitant with the retraction of the other piston 84), and the cyclical raising and lowering of each foot bar 52 thereby simulating human walking motion and assisting and encouraging the individual's rehabilitation of the lower extremities. Even though the device 10 will be mechanically raising and lowering the legs 14 through the up and down motion of the foot bar 52 and the foot bar support plate 54, the various muscles of the lower extremities will be strengthened and regain their original coordination and functioning in the process While a preferred embodiment of the invention has been shown and described, it will be understood by those skilled in the art that numerous modifications, alterations, and variations will be possible and practicable while still falling within the spirit and scope of the invention and the ambit of the appended claims.

We claim:

1. A motorized rehabilitative walking device for the physical rehabilitation of an individual's hips, feet, and legs, comprising:

a base for disposition on a level floor surface;

a pair of spaced-apart side supporting members upwardly extending from the base with each side supporting member having an exterior side and an interior side and supporting the individual therebetween during a rehabilitation session;

a pair of adjustable handle bars with one handle bar mounted to each side supporting member and the handle bars capable of selective independent vertical adjustment upon the respective side supporting members;

a manually operable control panel mounted to one handle bar for controlling the operation of device;

a pair of foot bar support plates disposed adjacent to the respective interior sides of the side supporting members and capable of reciprocable up and down motion for simulating a normal human walking motion;

a pair of foot bars with each foot bar secured to each respective foot bar support plate and upon which one foot of the individual is placed, the foot bars moving concomitant with the motion of the foot bar support plates for simulating normal human walking motion and facilitating the walking motion of the individual;

a pair of motors with each motor disposed within each respective side supporting member and both motors electrically interconnected to the control panel;

a pair of gear and pulley systems with each gear and pulley system disposed within each side supporting member for driving engagement by the motor; and a pair of pistons with each piston disposed within the respective side supporting member for connection to the foot bar support plate and drivingly engaged by the gear and pulley support for reciprocable extension and retraction thereby raising and lowering the foot bar support plate and foot bar in order to simulate normal human walking motion and facilitate the walking motion of the individual for physical rehabilitation of the hips, legs, and feet wherein the gear system comprises a motor and a drive shaft.

2. The motorized rehabilitative walking device of claim 1 further comprising a non-skid wear member disposed on the underside of the base for preventing the base from sliding upon the floor surface.

3. The motorized rehabilitative walking device of claim 2 wherein the control panel includes an on button, an off button, and a speed control dial.

4. The motorized rehabilitative walking device of claim 3 further comprising a pair of flexible foot straps with each foot strap attached to each foot bar support plate for securing the foot of the individual upon the foot bar.

5. The motorized rehabilitative walking device of claim 4 wherein the reciprocation of the pistons occurs out of phase by at least one cycle so that as one piston is extending for raising the attached foot bar and foot bar support plate the other piston is retracting for lowering the attached foot bar and foot bar support plate.

6. A motorized rehabilitative walking device for the physical rehabilitation of the hips, legs, and feet of an individual, comprising:

a base for disposition on a floor surface;

a pair of spaced-apart side supporting members upwardly extending from the base with each side supporting member including an exterior side, an interior side, and a hollow interior, and the side supporting members supporting the individual that is positioned therebetween for a rehabilitation session;

a pair of adjustable handle bars with each handle bar mounted to each respective side supporting member and the handle bars capable of selective independent vertical adjustment upon the respective side supporting members;

a manually operable control panel mounted to one handle bar for controlling the operation of the device;

a pair of foot bar support plates with each foot bar support plate disposed adjacent to the interior side of each respective side supporting member and the foot bar support plates capable of reciprocable up and down motion for simulating a normal human walking motion;

a pair of foot bars with each foot bar attached to each respective foot bar support plate and upon which one foot of the individual is placed with the foot bars moving up and down concomitant with the movement of the foot bar support plates for simulating normal human walking motion and facilitating the individual's walking motion;

a pair of motors with each motor encased within the hollow interior of the respective side supporting member and both motors electrically interconnected to the control panel;

a pair of pistons with each piston disposed within the hollow interior of the respective side supporting member and connected to the foot bar support plate with each piston capable of reciprocable extension and retraction for raising and lowering each foot bar support plate and foot bar in order to simulate normal human walking motion and to facilitate the walking motion of the individual undergoing physical rehabilitation of the hips, legs, and feet; and a means for interconnecting the motors to the pistons for actuating the cyclical and reciprocable extension and retraction of the pistons for raising and lowering the foot bar support plates and foot bars.

7. The motorized rehabilitative walking device of claim 6 further comprising a non-skid wear member disposed on the underside of the base for preventing the base from sliding upon the floor surface.

8. The motorized rehabilitative walking device of claim 7 wherein the control panel includes an on button, an off button, and a speed control dial that controls the speed of the extension and retraction of the pistons.

9. The motorized rehabilitative walking device of claim 8 further comprising a pair of flexible foot straps with each foot strap attached to each foot bar support plate for securing and holding the foot of the individual on the foot bar.

10. The motorized rehabilitative walking device of claim 9 wherein the reciprocation of the pistons occurs out of phase by at least one cycle so that as one piston is extending for raising the attached foot bar support plate and foot bar the other piston is retracting for lowering the attached foot bar support plate and foot bar in order to simulate normal human walking motion.

* * * * *